US006539965B1

(12) United States Patent
White, III

(10) Patent No.: US 6,539,965 B1
(45) Date of Patent: Apr. 1, 2003

(54) WATER WEIGHTED WALKING STICK

(76) Inventor: J. Phelps White, III, 105 W. 3rd St., Roswell, NM (US) 88201

( * ) Notice: Subject to any disclaimer, the term of this patent is extended or adjusted under 35 U.S.C. 154(b) by 0 days.

(21) Appl. No.: 09/866,840

(22) Filed: May 30, 2001

(51) Int. Cl.[7] ..... A61H 3/02
(52) U.S. Cl. ..... 135/66; 135/65
(58) Field of Search ..... 135/66, 65, 77, 135/69, 75, 911; 280/823, 826; D3/7, 8, 14, 18; 248/910

(56) References Cited

U.S. PATENT DOCUMENTS

| | | | | | |
|---|---|---|---|---|---|
| 255,299 | A | | 3/1882 | Keam | |
| 2,245,349 | A | * | 6/1941 | Lombardi | |
| 2,580,888 | A | | 1/1952 | Burkett | |
| 2,923,947 | A | * | 2/1960 | Weighill | |
| 2,960,148 | A | | 11/1960 | Murcott | |
| 3,443,820 | A | * | 5/1969 | Baker | |
| 4,077,076 | A | * | 3/1978 | Masters | 116/107 |
| 4,094,330 | A | | 6/1978 | Jong | |
| 4,407,318 | A | * | 10/1983 | Stuever | 135/66 |
| 5,330,065 | A | * | 7/1994 | Bradley | 108/139 |
| 5,482,070 | A | * | 1/1996 | Kelly | 135/66 |

* cited by examiner

*Primary Examiner*—Janet M. Wilkens
(74) *Attorney, Agent, or Firm*—Dowell & Dowell, P.C.

(57) ABSTRACT

A lightweight walking stick for providing stability when used in water which includes a hollow shaft having an upper handgrip and which shaft defines a chamber which retains water to provide ballast by way of vertically spaced openings spaced from a lower ground engaging end of the staff, such that water is permitted to fill and add weight to the lower portion of the staff when the stick is in use.

9 Claims, 2 Drawing Sheets

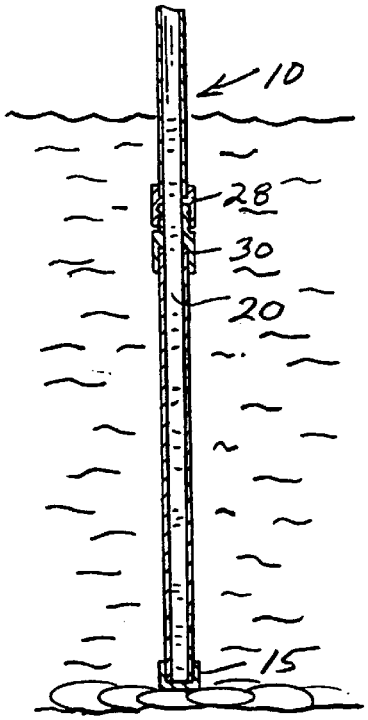
FIG. 3
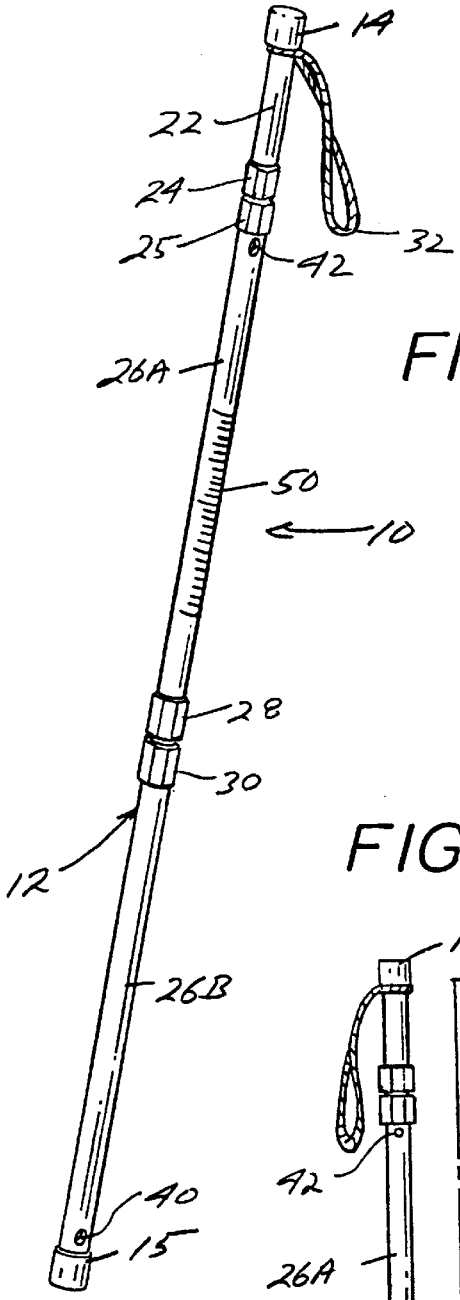
FIG. 2
FIG. 4
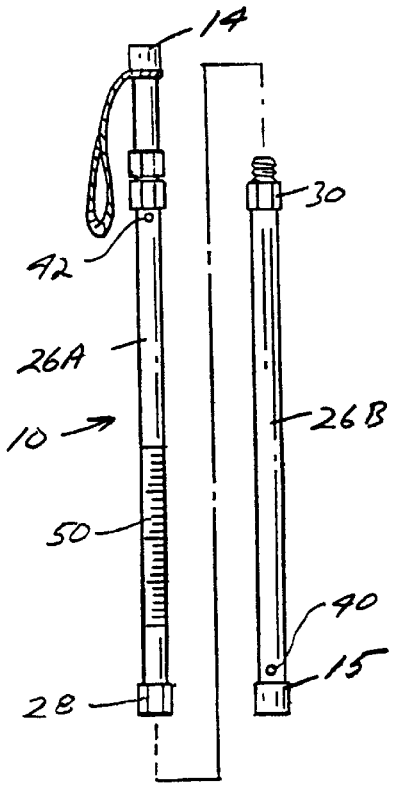

WATER WEIGHTED WALKING STICK

BACKGROUND OF THE INVENTION

1. Field of the Invention

This invention is generally directed to walking sticks or canes and, more particularly, to lightweight walking sticks formed of sturdy tubular material and which are constructed so as to provide liquid weight or ballast to prevent floatation of the sticks when used when wading in water.

2. Discussion of the Related Art

Conventional walking sticks or canes normally include a solid wooden or other material shafts and may include an upper handgrip or hooked end portion for facilitating manual gripping of the walking stick during use. The shafts must be sufficiently rigid to support the weight of an individual during use and frequently, such walking sticks must be able to support considerable weight especially when climbing or when walking through rugged terrain.

Due to the need for rigidity and strength, most walking sticks are formed of heavy materials, the weight of which can be detrimental when walking, especially for long distances or when walking or hiking in remote or rugged terrain.

Conventional walking sticks are also primarily designed and constructed for use on dry land and are not normally considered appropriate for use to facilitate an individual when wading in a fast moving stream. Further, many materials from which conventional walking sticks or canes are made are buoyant in water and, if used while wading in a fast moving stream, can float and be carried away by the fast moving currents.

In view of the foregoing, there is a need to improve upon conventional walking sticks by providing a walking stick which is not only durable, but one which is light in weight, thereby facilitating portability, and further, one which can be used in water for purposes of facilitating movement of a fisherman in a fast moving river or stream. Such a walking stick should also provide weight or ballast when used in water, such that there is less tendency of the walking stick to float and be carried away from an individual by fast moving water.

SUMMARY OF THE INVENTION

The present invention is directed to a lightweight walking stick which is preferably an elongated hollow staff formed of a plastic material which staff includes upper and lower ends and which also defines an interior ballast chamber for receiving water when a lower portion of the walking stick is immersed in a body of water, such as a river or stream. An upper portion of the staff of the invention is configured as a handgrip with the upper end of the staff being covered by an end cap and with the lower tip of the staff being covered by a lower end cap, which in a preferred embodiment may include a slip resistant outer surface, such as of rubber.

In some embodiments, the walking stick may include one or more couplings which assemble separate staff sections in axial alignment and which couplings not only permit the walking stick to be compactly disassembled for ease of portability, but also provide additional rigidity by reinforcing portions of the staff along its length.

The walking stick of the present invention is specifically designed to provide for a liquid ballast when used in water, such as when used by a fisherman fly fishing in a fast moving stream. To permit water to enter and exit the ballast chamber defined by the staff, spaced openings are provide in the staff of the walking stick, such that water enters a lowermost opening or openings to fill the ballast chamber when the lower end of the walking stick is immersed in water. Upon raising the walking stick, water and weight is dissipated by providing upper air holes which allow for air to force the water out of the lower holes or openings.

In some embodiments, to facilitate the manipulation of the walking stick and also to prevent accidental displacement of the walking stick, a flexible handloop may be provided adjacent to a handgrip portion of the staff through which an individual's hand may be inserted, thus further ensuring that the stick cannot be accidentally released.

It is a primary object of the present invention to provide a lightweight walking stick which includes a ballast chamber into which water enters whenever the lower portion of the stick is immersed in water. The water which enters the stick provides weight and ballast to prevent flotation of the walking stick. The water within the ballast chamber freely flows from the walking stick when the stick is raised above water level.

It is also an object of the present invention to provide a light weight walking stick which, in some embodiments, may be disassembled into separate sections utilizing intermediate couplings which not only provide for a more compact and portable assembly, but which also provides reinforcement for the walking stick when assembled.

It is yet a further object of the invention to provide a unique structure for a walking stick or cane which is particularly adapted for use by fishermen when wading in fast moving waters to provide stability and slip resistance and which becomes ballasted or weighted by water entering and weighting the stick when immersed in water.

BRIEF DESCRIPTION OF THE DRAWINGS

A better understanding of the invention will be had with respect to the attached drawing figures wherein:

FIG. 2 is a front perspective view of the walking stick;

FIG. 3 is a partial cross-sectional illustrational view of the invention showing water filling the internal chamber when the staff of the walking stick is immersed; and FIG. 4 is an assembly view of the invention.

DESCRIPTION OF THE PREFERRED EMBODIMENT

Figure 1:
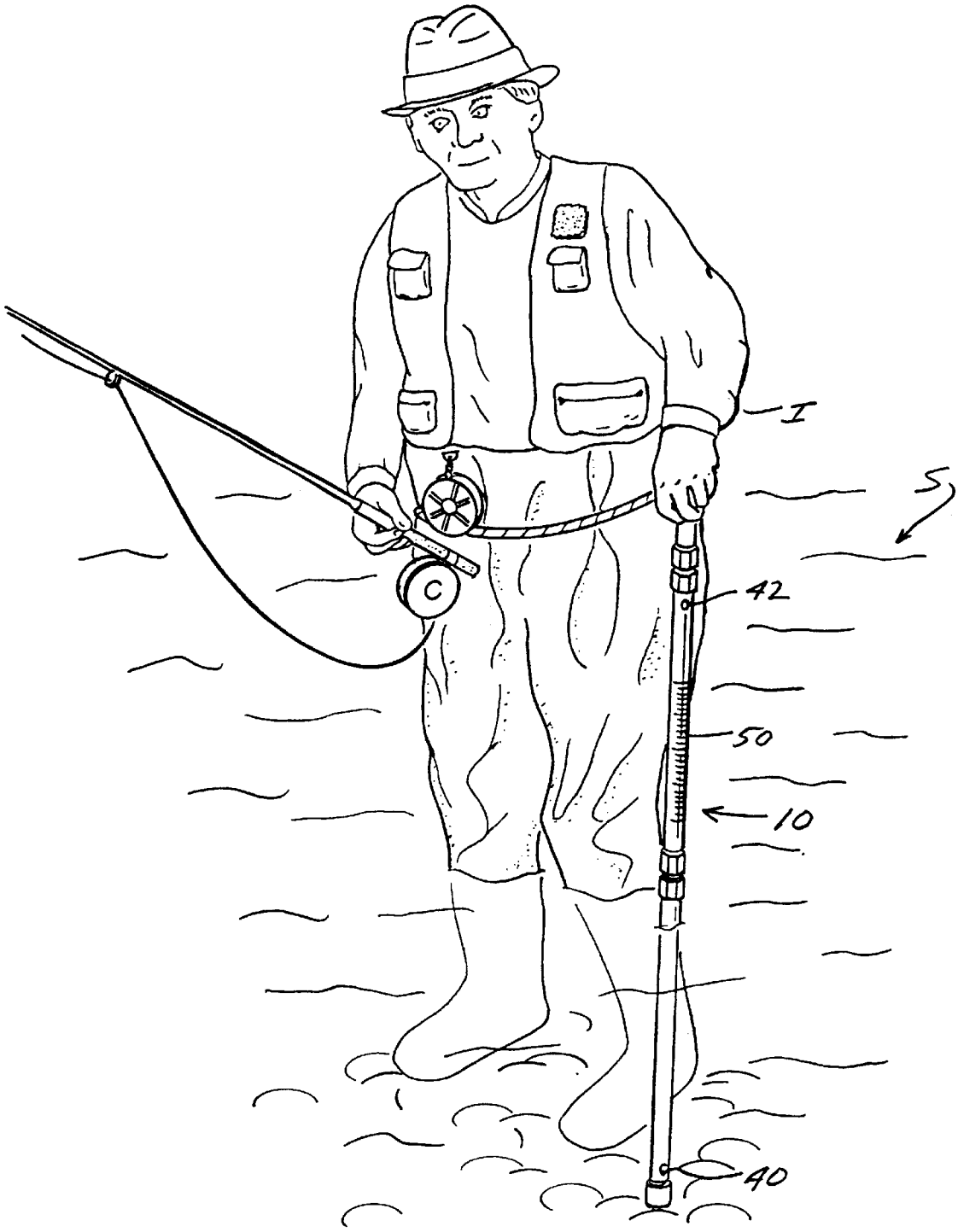
FIG. 1 is a perspective illustrational view of the invention in use.

With continued reference to the drawing figures, the walking stick 10 of the present invention is shown in FIG. 1 as being used by an individual "I", fishing within a fast moving stream "S". As shown, the walking stick 10 provides stability for the individual allowing the individual's weight to be supported when maneuvering over rocks and through fast moving waters.

The walking stick includes a hollow staff or shaft 12 which preferably is formed of a plastic material, such as a ¾ inch PVC (polyvinylchloride) plastic pipe. The upper end of the staff is covered and closed by a cap 14 which may be permanently secured thereto, and the lower end of the staff is sealed and covered by a lower cap 15. In some embodiments, the lower cap may be rubber or a similar material to provide increased friction in the area of the tip of the walking stick.

The staff of the walking stick is hollow and defines an internal ballast chamber 20, see FIG. 3, which receives water whenever the walking stick is immersed in a body of water.

In the preferred embodiment shown in the drawing figures, an upper portion of the staff of the walking stick includes a handgrip area 22 which extends from the upper cap 14 to a coupling member 24. The coupling member 24 is formed of a female connector to which sections 22 and 26 of the staff are seated. The coupling member 24 not only defines the handgrip area 22, but provides reinforcement along the upper portion of the staff of the walking stick.

In some embodiments, the walking stick may be formed with a plurality of staff sections, such as shown at 26A and 26B in FIGS. 2 and 4 which are joined by a coupling 30. In this manner, the staff sections 26A and 26B may be assembled and disassembled to facilitate handling of the walking stick when not in use. Further, the coupling 30 provides an additional point of rigidity along the length of the staff. Additional sections may also be used for the staff and be in accordance with the teachings of the invention.

To facilitate maneuverability of the staff and prevent accidental release of the walking stick, a handloop 32 is provided through the upper portion of the handgrip area 22 through which and individual may insert a hand, such that the walking stick is supported about the wrist of the individual.

As previously noted, one of the advantages of the walking stick of the invention is that the interior of the staff is formed as a ballast chamber which receives water when the lower portion of the walking stick is immersed in water, such as when an individual uses the walking stick in a stream or other body of water. The water entering the lower portion of the staff causes weight to be added to the staff to stabilize the staff during use. Further, the admission of the water prevents the staff from floating, as would be the case if the interior were merely a sealed air chamber.

To allow entrance of water into the lower portion of the staff, in the preferred embodiment, a single opening, such as a ¼ inch hole 40, is provided through the wall of the staff to communicate with the ballast chamber. The hole 40 is positioned just above the lower cap 15. In some embodiments, two or more openings may be provided to permit entry of water into the lower portion of the staff. Water will assume the same level within the ballast chamber as the depth of water in which the tip of the staff has been immersed as air escapes through openings 42 provided vertically spaced above the openings 40. Further, the air openings 42 permit water to be released from the interior ballast chamber upon the staff being raised, such that the opening(s) 40 are above the water level, thus allowing discharge of water and a reduction of weight of the walking stick.

In view of the foregoing, the present invention not only provides for a walking stick which is light in weight, but also provides for one which has an automatic ballast, such as to provide weight to the walking stick when immersed in water. Further, in some embodiments, the walking stick may be assembled in a plurality of sections which may be easily disassembled for storage and portability when the walking stick is not in use.

The coupling at the upper end of the staff should provide for a handgrip area of approximately five inches, and the overall length of the staff of the walking stick may be approximately 42 inches, however, the length will be determined by the height of the individual using the walking stick. A 42 inch ¾ diameter inch PVC will have a weight of approximately 12 ounces. Such a lightweight walking stick will not be a burden to carry and thus will provide a valuable stabilizing tool for individuals not only walking, but hiking or wading in fast running and rocky streams.

With particular reference to FIGS. 1, 2 and 4, a modification of the invention incorporates a scale 50 of units of measure, such as in inches or millimeters, which can be utilized to determine the size or length of a fish which has been caught by an individual utilizing the walking stick of the invention.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A walking stick including an elongated hollow staff of buoyant material having an upper end and a lower end and defining an interior liquid receiving chamber, at least one first opening in a lower portion of said staff and spaced from said lower end of a size to permit water to freely pass therethrough so as to enter into and drain from said chamber, at least one second opening in said staff spaced vertically above said at least one first opening to permit air flow into and out of said chamber as water enters said chamber to thereby provide weight for the stick when said lower portion of said staff is immersed in water and subsequently drains from said chamber when said lower portion of said staff is raised above the water, and said chamber being of a sufficient volume to prevent flotation of the walking stick when water is contained therein.

2. The walking stick of claim 1 wherein an upper portion of said staff includes a handgrip area adjacent said upper end thereof, said at least one second opening being spaced below said handgrip area towards said lower portion of said staff.

3. The walking stick of claim 2 including an upper end cap for closing said upper end of said staff.

4. The walking stick of claim 2 including a tether secured to said upper portion of said staff adjacent said handgrip area.

5. The walking stick of claim 1, in which said staff includes at least two sections, and coupling means for selectively connecting said at least two sections of said staff whereby said at least two sections can be disassembled for compact storage.

6. The walking stick of claim 1 wherein said staff is formed of a lightweight plastic material.

7. The walking stick of claim 1 wherein said staff is generally liquid impervious with the exception of said at least one lower opening and said at least one second opening.

8. The walking stick of claim 1 wherein said lower end includes a lower end cap which cap is covered by a shock absorbing material.

9. The walking stick of claim 1 including a scale of units of measure provided along a portion of a length of said staff.

* * * * *